US006148896A

United States Patent [19]

Pinto et al.

[11] Patent Number: 6,148,896

[45] Date of Patent: Nov. 21, 2000

[54] METHOD AND APPARATUS FOR OVERLAYING A GARAGE DOOR

[76] Inventors: Joseph Pinto; Carol J. Pinto, both of P.O. Box 163, Champlin, Minn. 55316

[21] Appl. No.: 09/316,904

[22] Filed: May 22, 1999

Related U.S. Application Data

[60] Provisional application No. 60/086,532, May 22, 1998.

[51] Int. Cl.[7] ..... E06B 9/00

[52] U.S. Cl. ..... 160/229.1; 160/201; 160/232; 160/236; 49/197; 49/501

[58] Field of Search ..... 160/229.1, 201, 160/232, 236; 52/309.9, 309.14, 745.15, 745.16, 47, 48, 49; 49/197, 198, 501

[56] References Cited

U.S. PATENT DOCUMENTS

| | | | |
|---|---|---|---|
| 3,967,671 | 7/1976 | Stanley et al. . | |
| 4,436,136 | 3/1984 | Downey, Jr. . | |
| 4,828,004 | 5/1989 | Martinez et al. | 160/229.1 |
| 5,016,700 | 5/1991 | Wegner et al. . | |
| 5,073,429 | 12/1991 | Steinke et al. . | |
| 5,177,868 | 1/1993 | Kyle et al. | 29/897.32 |
| 5,435,108 | 7/1995 | Overholt et al. | 52/309.11 |
| 5,445,208 | 8/1995 | Shaner et al. . | |
| 5,598,667 | 2/1997 | Dykes | 160/236 X |
| 5,626,176 | 5/1997 | Lewis, Jr. et al. . | |
| 5,638,648 | 6/1997 | Rotondo | 49/501 X |
| 5,709,259 | 1/1998 | Lewis et al. | 160/201 |
| 5,743,057 | 4/1998 | Martin | 49/501 X |
| 5,943,803 | 8/1999 | Zinbarg | 160/236 X |

*Primary Examiner*—Bruce A. Lev

[57] ABSTRACT

An overlay for a sectional garage door extends between adjacent panel sections of the door. The overlay has a plurality of members made of extruded polystyrene. The overlay members extending from one section of the door to an adjacent section are cut along the centerline between door sections to allow the door to open and close and provide an aesthetically pleasing and professional appearance without gapping.

13 Claims, 5 Drawing Sheets

METHOD AND APPARATUS FOR OVERLAYING A GARAGE DOOR

CROSS REFERENCE TO RELATED APPLICATION

This application is a continuation of U.S. Provisional Patent Application Ser. No. 60/086,532 filed May 22, 1998.

FIELD OF THE INVENTION

The invention relates to garage doors having overlay structures and methods for making the same. Particularly, the invention relates to custom designed overlays for a non-wood sectional garage door having hinged door sections.

BACKGROUND OF THE INVENTION

Commonly, home owners and building owners in the market for a new sectional garage door or warehouse door desire a unique look to enhance the value and beauty of their home or business by having the front of the door overlaid with a custom design or logo.

In the past door sections for sectional garage doors and overlays used to custom design the front of the doors were made of wood. These wooden structures have a tendency to split, crack, splinter, wrap and rot over time with exposure to temperature fluctuations, moisture, dampness, ice, sunlight and other elements and weather-related influences. The wood garage door sections and overlays require frequent repair and painting to maintain the appearance of the door.

More recently, sectional doors made of metal, such as steel or aluminum, have been used in new construction to enclose garages or as replacement for garage doors manufactured of wood due to the typically lighter weight of metal door sections and thermal insulating properties thereof. However, wooden overlays are not compatible with metal garage doors.

SUMMARY OF THE INVENTION

The invention is an overlay structure for a non-wood garage door, such as a steel sectional garage door, and a method of making the overlay and applying the overlay to the door whereby the finished overlay pattern has an aesthetically pleasing and professional appearance without gapping.

The sectional garage door has a plurality of rectangular-shaped door sections or panels. Pivot joint assemblies attached to the door panels pivotally connect the door panels. Each door panel has an outer surface made of a non-wood material, such as steel. An custom designed overlay is secured to the outer surface and protrudes outwardly from the outer surface providing the door with a contrasting appearance from the appearance of the outer surface of the door. The overlay has a plurality of linear transverse members extending across the door panels. A pair of upright members extend from one door panel to an adjacent door panel. The transverse members extend between the upright members generally parallel to each other. Each upright member has a central opening and end openings on each end of the member on opposite sides of the central opening. The upright members extending from one door panel to an adjacent door panel have sections with ends engaging each other when the door is in a vertical closed position. The ends separate when the door is pivoted between the open and closed. Adhesive material compatible with the outer surface of the door and the overlay members is used to secure the members to the outer surface. Fasteners extending through the transverse members and upright members and into the door panels further support the members on the door panels to aid in the bonding process.

A modification of the overlay has a first pair of intersecting diagonal members and a second pair of intersecting diagonal members. Each diagonal member extends from one door panel to an adjacent door panel. An upright member extending from one door panel to an adjacent door panel is located between the first and second pairs of diagonal members.

The method of manufacturing an overlay for a sectional door having a plurality of pivotally connected door sections comprises placing the door sections in a jig. The jig holds the door sections in a vertical position substantially the same as the sections are vertically held in a door opening at a job site. The adjacent ends of the door sections are spaced at a uniform width in the jig. An overlay having a selected shape and design is prepared. The overlay extends from one section to an adjacent section of the door. The overlay is secured to the outer surfaces of the door sections and is cut adjacent the spacing between the door sections. The size of the cut of the overlay has substantially the same width as the width of the spacing between adjacent door panels. The perimeter of the overlay adjacent the outer surfaces of the door panels is sealed to prevent the entry of moisture and foreign material.

DESCRIPTION OF PREFERRED EMBODIMENTS

Figure 1:
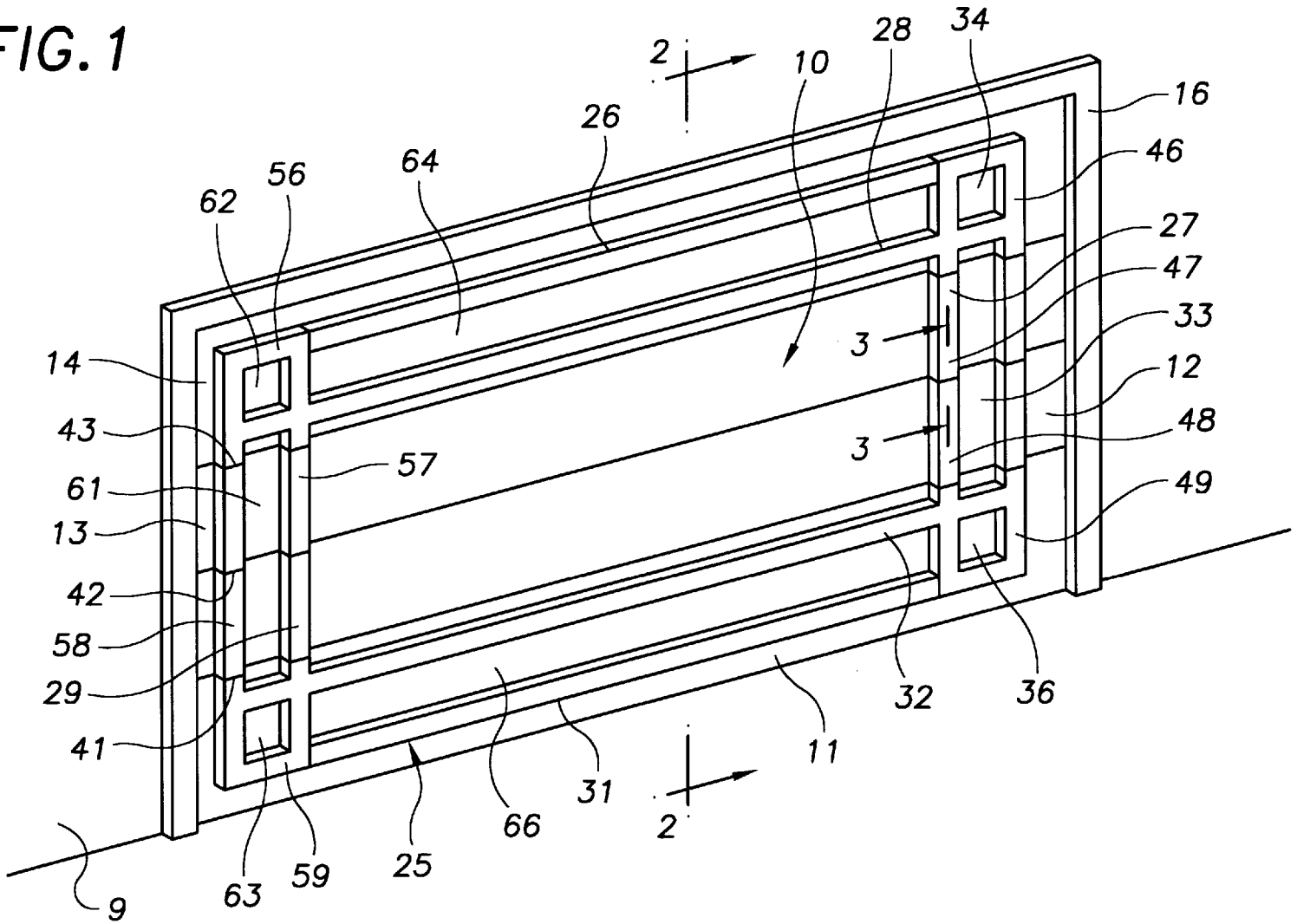
FIG. 1 is a perspective view of a sectional door with an overlay of the invention attached to the exterior surface of the door.

Referring to FIG. 1, there is shown an overhead door, indicated generally at 10, used to enclose an outer opening of a structure 9, such as a warehouse, a garage for a residential dwelling or the like. Door 10 is a generally rectangular member extending the width and height of the entry opening of structure 9. Door 10 is supported for movement along conventional bracket mounted tracks on the door jamb or frame 16 between an open horizontal position and a closed vertical position, as shown in FIG. 1. Door 10 usually has a plurality of rectangular-shaped panels or door sections 11, 12, 13 and 14 that are hinged together to permit the pivoting of two adjacent sections as door 10 is moved from its vertical position to an overhead horizontal position. Pivoting joints 17 attached to the back of the door sections 11–14 have graduated hinges 22 and rollers 23 to pivotally connect adjacent sections 11 and 12, 12 and 13, and 13 and 14.

Figure 2:
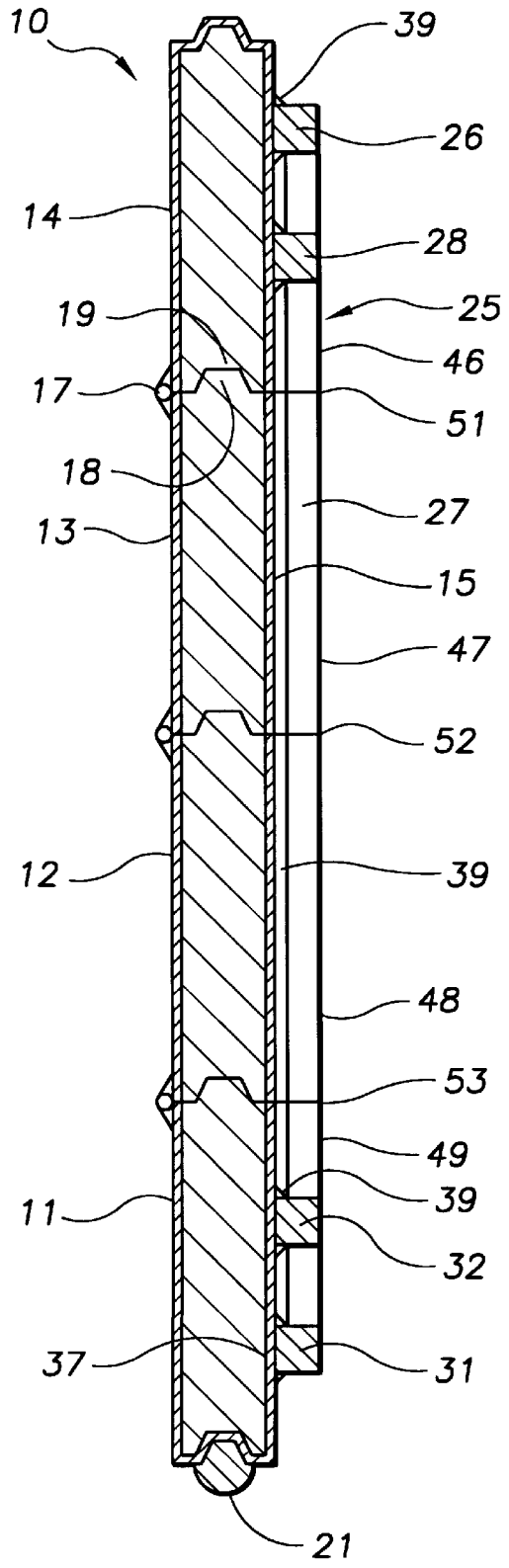
FIG. 2 is an enlarged sectional view taken along the line 2—2 of FIG. 1.

As shown in FIG. 2, the tops of each door section 11, 12 and 13 has a rib 18 that aligns with and is accommodated by a groove 19 in the bottom of adjacent section 12, 13 and 14 when door 10 is in the vertical closed position. Groove 19 in the bottom of section 11 accommodates a weather-sealing strip 21 which engages the floor of structure 9 to seal door 10 along its bottom edge. Door sections 11–14 have an outer layer 15 made of a non-wood material, such as metal, plastic, and/or fiberglass. Preferably, the outer layers 15 of door sections 11–14 are made of 24 gauge galvanized steel having an acrylic or polyester exterior coating.

As shown in FIG. 1, door 10 has a facade or an overlay of the invention, indicated generally at 25, attached to the exterior surface of door 10. Overlay 25 has a decorative and custom design extending across the front of door 10 from top door section 14 to bottom door section 11. Overlay 25 functions also to reinforce the outer layers 15 of door sections 11–14. Preferably, overlay 25 is made of rigid extruded polystyrene thermoplastic, which is lightweight, structurally strong and is easily cut, routed and/or planed. Other rigid workable materials can be used to construct overlay 25. Overlay 25 protrudes outwardly from outer layer 15 to provide a contrasting aesthetic appearance to door 10. When door 10 is rolled up and down the outer surface of overlay 25 clears the top of frame 16 of structure 9.

As shown in FIG. 1, overlay 25 has a plurality of linear transverse members 26, 28, 31 and 32 that project outwardly from the outer surface 15 of door 10 and extend generally parallel to each other across the front of door sections 11 and 14. Linear transverse members 31 and 32 extend across the front of bottom door section 11 and transverse members 26 and 28 extend across the front of top door section 11. Transverse members 26, 28, 31 and 32 are generally parallel to the bottom edge of door 10 and have substantially the same width, thickness and length. Overlay members 26, 28, 31 and 32 can have curved portions, or have other widths and thickness, dissimilar structures, and/or designs, as desired. Members 26, 28, 31 and 32 can also extend between adjacent door sections.

Overlay 25 has also a pair of rectangular-shaped end members 27 and 29 which abut the outer ends of transverse members 26, 28, 31 and 32 to define rectangular openings 64 and 66 on the top section 14 and bottom section 11 of door 10. Transverse members 31 and 32 extend across door section 11 between end members 27 and 29. Transverse members 26 and 28 extend across door section 14 between the top of end members 27 and 29. As seen in FIG. 1, end member 27 has a rectangular-shaped central or middle opening 33. A square-shaped opening 34, 36 is located on each end of member 27. End member 27 extends along one side of door 10 from the top of door 10 to the bottom thereof across adjacent door sections 11–14.

As shown in FIG. 2, end member 27 is separated or cut into a plurality of sections 46, 47, 48 and 49 thereby permitting door panels 11–14 to pivot on joints 17 when door is rolled up and down. As end member sections 46–49 come into the same plane, as when door 10 is in its vertical closed position, the ends of adjacent sections 46–49 are co-planar and abut squarely at junctions 51, 52 and 53 providing a substantially tight fit relationship between adjacent sections 46–49. This effectively prevents the entry of moisture and other foreign matter between the ends of adjacent sections 46–49. Also, gapping between sections 46–49 is substantially eliminated adding to the aesthetic appearance of door 10. Junctions 51–53 are aligned with the interfaces between adjacent doors 11–14. Overlay member 27 can have other shapes and designs as desired.

Overlay end member 29 is structurally identical to end member 27. Returning to FIG. 1, end member 29 has a centrally located rectangular-shaped opening 61 and square-shaped end openings 62 and 63 on opposite ends of member 29. End member 29 extends along one side of door 10 on the side of the door opposite from end member 27. End member 29 extends from top door panel 14 across middle door panels 12 and 13 to bottom door panel 11. End member 29 is divided into a plurality of sections 56, 57, 58 and 59 to allow door panels 11–14 to pivot when door 10 is opened and closed. When door 10 is in the vertical closed position, the ends of adjacent sections 56–59 abut squarely at junctions 41, 42 and 43 in a tight fitting relationship whereby entry of moisture and other foreign matter is prevented and the professional and aesthetic appearance of door 10 is enhanced due to the lack of gaps in end member 29 and overlay 25. Junctions 41–43 are aligned with the interfaces between adjacent door panels 11–14 and junctions 51–53 of end members 46–49. Overlay end member 29 can have other shapes and designs as desired that are either substantially the same as or different from the shape and/or design of overlay end member 27 and transverse members 26, 28, 31 and 32.

Figure 3:
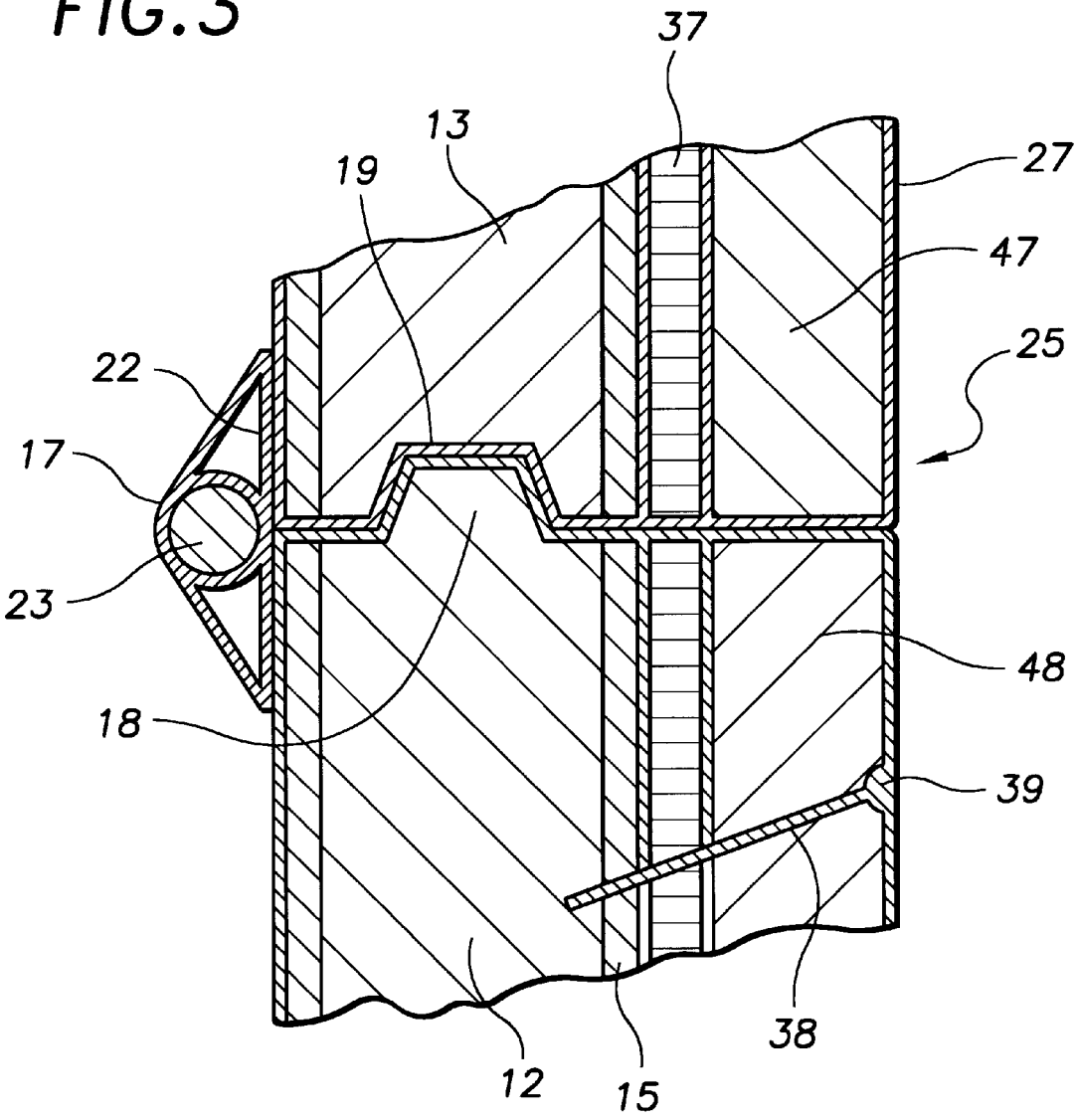
FIG. 3 is an enlarged sectional view taken along the line 3—3 of FIG. 1.

Overlay 25 is attached to the exterior surface 15 of door 10 with an adhesive material 37. Adhesive material 37 is compatible with the material of outer surface 15 of door 10, the finish of outer surface 15, and with the material of overlay 25. Preferably, adhesive material 37 is a commercially available construction adhesive, such as PL200 or FYPON construction adhesives, achieving strengths of about 600 pounds per square inch, which is water-resistant and resistant to temperature fluctuations. Adhesive material 37 has a uniform application between overlay 25 and the outer surfaces 15 of panels 11–14 to bridge any gaps between overlay 25 and outer surface 15. Fasteners 38, such as pin nails or galvanized sheet metal screws, are used to hold overlay members 26–32 in place during the bonding process. As shown in FIG. 3, fastener 38 extends through end member 29, adhesive material 37, and outer layer 15, and into the interior of door panel 12 at an angle to support end member 27 on the door panel. Fastener 38 is countersunk into member 27, such as about 1/16 to 1/8 of an inch. Similar, fasteners 38 hold overlay members 26, 28, 29, 31 and 32 in proper alignment on the exterior surface 15 of door 10.

The perimeter of overlay 25 located adjacent the outer surface 15 of door 10 is caulked or sealed with a sealant 39. As shown in FIG. 2, a bead of sealant 39 is located between the lower edges of transverse members 26, 28, 32 and 32 and the outer surface 15 of panel 14. Sealant 39 is also located between the lower edges of end members 27 and 29 and outer surface 15. The entry points of fasteners 38 into overlay 25 are similarly caulked or sealed with sealant 39, as seen in FIG. 3. Sealing the perimeter of the overlay and entry points of fasteners 38 prevents entry of moisture and other foreign matter. Preferably, sealant 39 is a siliconized latex material or a polyurethane sealant, such as VULKEM sealant. Other sealants can be used to seal the perimeter of overlay and the fastener entry points.

To make an overlay 25 for a sectional garage door 10, door panels 11–14 are mounted in a jig in a manner substantially the same as door 10 would be installed in frame 16 of structure 9 at a selected job site. A plurality of shims or spacers (not shown) are positioned between adjacent ends of door sections 11–14 to transversely space the adjacent ends of sections 11–14. The spacers have a width approximately equal to the width of a conventional saw blade, such as 1/16 to 3/8 of an inch. This allows overlay end members 27 and 29, which extend from bottom door panel 11 to top door panel 14 across adjacent panels 12 and 13, to be cut along the transverse joint line or centerline between the door panels 11–14 resulting in an overlay 25 having a professional finish void of gaps at junctions 41–43 and 51–53 in end members 27 and 29.

A desired design for overlay 25 is selected. For example, overlay 25 can have a plurality of transversely spaced generally parallel linear members 26, 28, 31 and 32 that extend between a pair of upright rectangular-shaped members 27 and 29, as shown in FIG. 1. Upright end members 27 and 29 have cut-out rectangular middle portions 33 and 61 and cut-out square end portions 34 and 36, and 62 and 63. Upright end members 27 and 29 extend from the bottom to the top of door 10 across door panels 11, 12, 13 and 14. Overlay 25 can have other widths, thicknesses or shapes and designs as desired. For example, overlay 25 can have diagonal members that extend parallel to each other, that intersect each other at a mid point of door 10, or that are curved, or the form letters and/or logos. Preferably, overlay members 26–32 are made of extruded polystyrene. Using extruded polystyrene to make members 26–32 of overlay 25 allows the members 26–32 to be easily cut, shaped or planed to a desired width, thickness or shape, and also reinforces the outer surface 15 of door 10.

After an overlay design is selected, the design of overlay 25 is outlined on the exterior surface 15 of door 10. A chalk line or other marking devices can be used to snap out or outline the design of overlay 25 on the outer surface 15 of door 10 to facilitate proper alignment of overlay members on door 10. Overlay members 26–32 are attached to door sections 11–14 with adhesive material 37. Adhesive material 37 is compatible with the outer surface 15 of door 10, the finish of outer surface 15 and overlay 25. Adhesive material 37 is applied uniformly between adjacent surfaces of door sections 11–14 and overlay members 26–32 to fill any gaps between outer surface 15 and overlay 25. Preferably, adhesive material 37 is a construction adhesive which easily bridges gaps between the outer surface 15 of door panels 11–14 and overlay 15, and is resistant to moisture, dampness and temperature fluctuations. Adhesive material 37 is allowed to dry approximately three days at 45 to 85 degrees Fahrenheit and relative humidity of 10 to 70 percent. Variances in temperature and/or relative humidity will effect the drying time required for adhesive material 37.

To aid in the bonding process overlay members 26–32 are held in place with fasteners 38, such as pin nails, or galvanized sheet metal screws. Fasteners 38 are countersunk into members 26–32 and are installed at an angle, as shown in FIG. 3.

After adhesive 37 has been allowed to dry, end members 27 and 29 extending from top door panel 14 to bottom door panel 11 are cut along lines which are aligned generally parallel to the centerlines between the ends of adjacent panels 11 and 12, 12 and 13, and 13 and 14 to form end member sections 46–49 and 56–59. The width of the saw blade used to cut end members 27 and 29 into sections 46–49 and 56–59 is substantially the same as the width of the spacing between adjacent ends of panels 11–14 supported by the jig. The material portions cut from end members 27 and 29 have a width the same as the width of the space between the adjacent ends of the panels whereby the ends of adjacent end member sections 46–49 and 56–59 will engage in a tight fit manner with no gaps when the spacers are removed from the adjacent door panels 11–14 and door 10 is installed at the job site. A chalk line or other suitable marking device can be used to snap out or mark the cutting guide lines on members 27 and 29. Members 27 and 29 are cut adjacent the interfaces between panels 11–14 into sections 46–49 and 56–59 to allow panels 11–14 to pivot on joints 17 when door 10 is moved from open to closed positions and vice versa.

After members 27 and 29 have been cut into sections 46–49 and 56–59, the spacers between adjacent panels 11–14 are removed, and the door panels are released from the jig. The perimeter areas of overlay 25 located adjacent the outer surface 15 of door 10 are caulked or sealed with sealant 39. All entry points of fasteners 38 are also sealed or caulked with sealant 39. The sealant 39 is allowed to dry approximately two days. Variances in temperature and/or relative humidity will effect the drying time for sealant 39. Door 10 is then installed in frame 16 at the job site. Door 10 and overlay 25 are painted to prevent photochemical reaction between the materials of members 26–32 and sealant 39.

Figure 4:
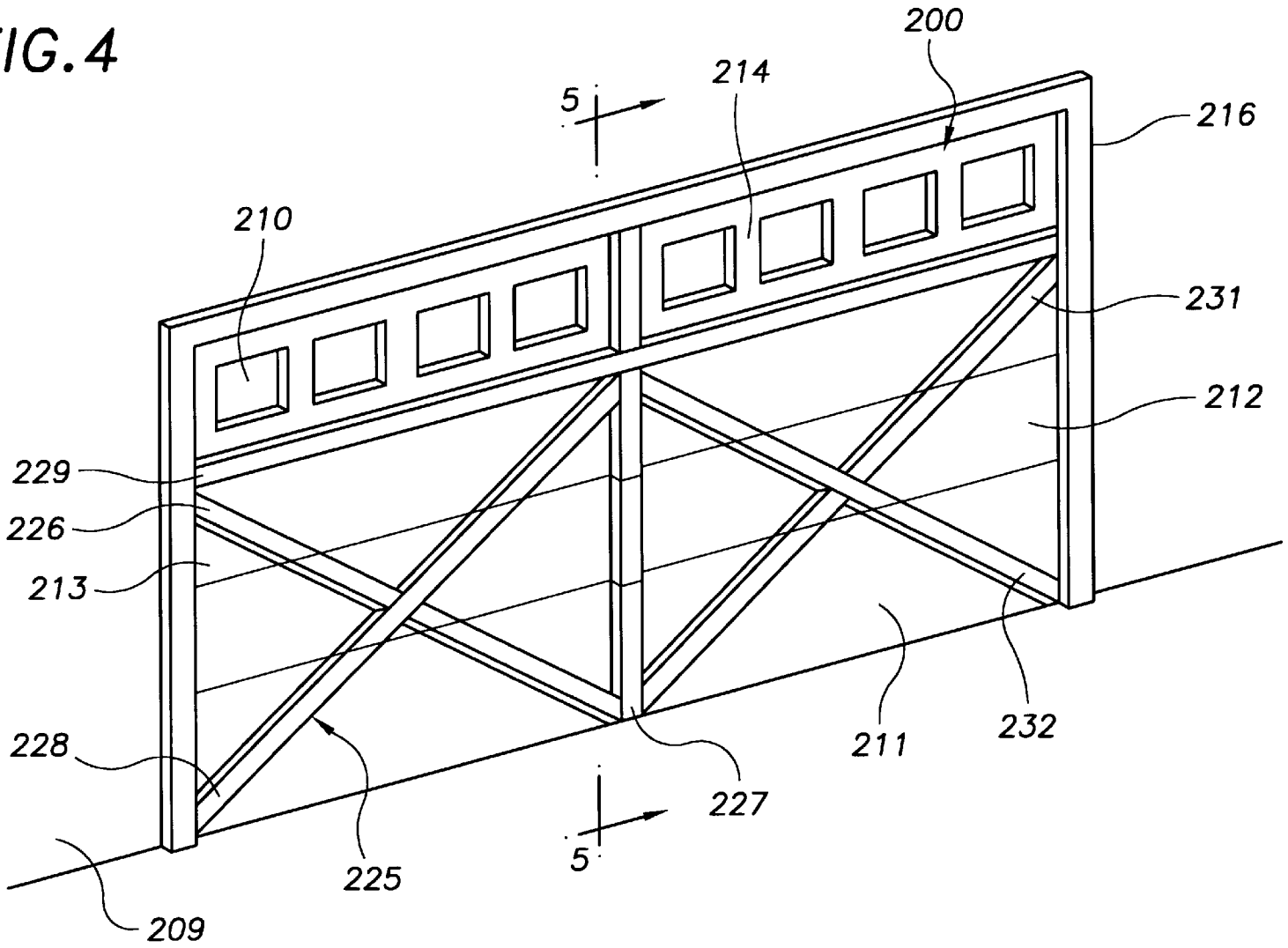
FIG. 4 is a perspective view of a modification of the sectional door with the overlay of the invention.
Figure 5:
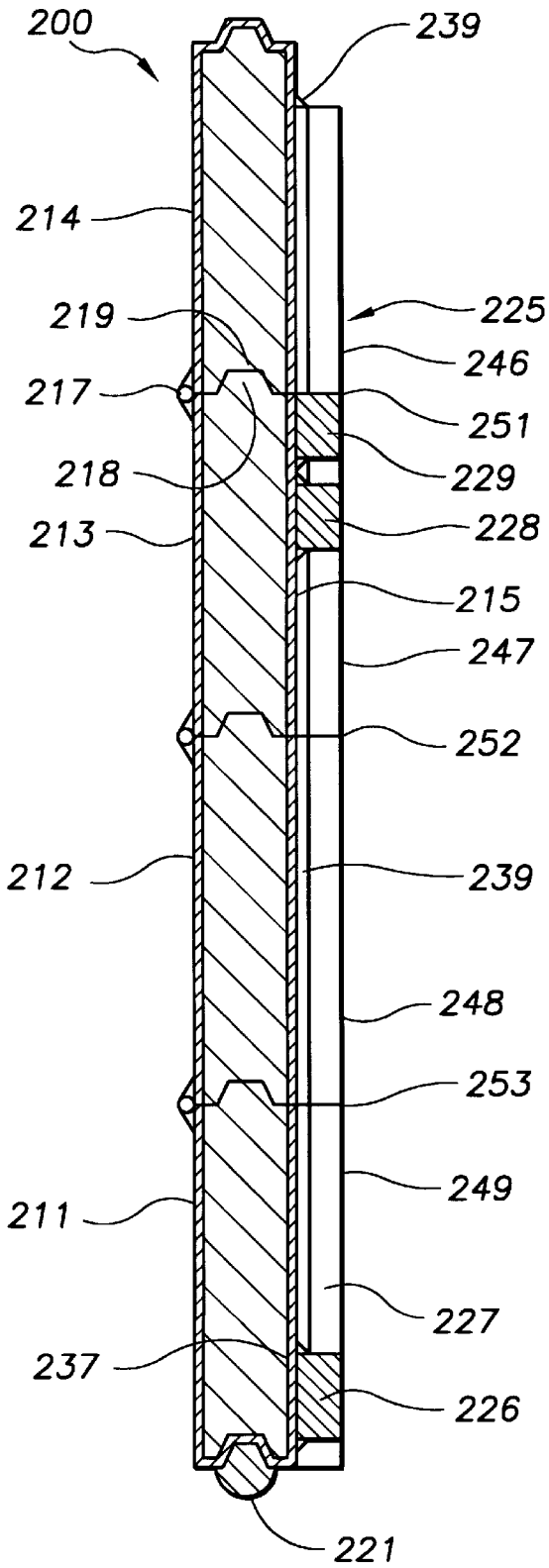
FIG. 5 is an enlarged sectional view taken along the line 5—5 of FIG. 4.

Referring to FIGS. 4 and 5, there is shown a modification of an overlay of the invention, indicated generally at 225, attached to the exterior surface of a sectional garage door 200 for a structure 209. Door 200 has a plurality of panels 211, 212, 213 and 214 pivotally connected with pivoting joints 217. Each panel 211–214 has a rib 218 and groove 219 that align with the corresponding rib and groove of adjacent panels to hold the panels in alignment. Groove 219 in the bottom of panel 211 accommodates a weather sealing strip 221 which engages the floor of structure 209 to seal door 200 along its bottom edge. Top panel 214 has a plurality of windows 210. Door panels 211–214 have an outer layer 215 made of a non-wood material, such as metal, plastic, and/or fiberglass. Preferably, the outer layers 215 of door panels 211–214 are made of 24 gauge galvanized steel having an acrylic or polyester exterior coating.

Overlay 225 has a decorative and custom design extending across the front of door 200 between door sections 211–214. Overlay 225 functions also to reinforce the outer layers 215 of door sections 211–214. Overlay 225 is made of a rigid workable material, such as extruded polystyrene thermoplastic, which is lightweight, structurally strong and is easily cut, routed and/or planed. Overlay 225 protrudes outwardly from outer layer 215 to provide a contrasting aesthetic appearance to door 200.

As shown in FIG. 4, overlay 225 has a plurality of diagonal linear members 226, 228, 231 and 232 that project outwardly from the outer surface 215 of door 200. Diagonal members 226 and 228 intersect at a midpoint of panel 212. Similarly, diagonal members 231 and 232 intersect at a midpoint of panel 212 opposite from the intersection of diagonal members 226 and 228. A central upright member 227 is located between diagonal members 226 and 228 and diagonal members 231 and 232 in the middle of door 200. A linear transverse member 229 extends across the front of panel 213 adjacent the tops of diagonal members 226, 228, 231 and 232.

As shown in FIG. 5, upright member 227 is separated or cut into a plurality of sections 246, 247, 248 and 249 thereby permitting door panels 211–214 to pivot on joints 217 when door 200 is rolled up and down. As end member sections 246–249 come into the same plane, as when door 200 is in its vertical closed position, the ends of adjacent sections 246–249 abut squarely at junctions 251, 252 and 253 aligned with the interfaces between adjacent door panels 211–214 providing a substantially tight fit relationship between adjacent sections 246–249. This effectively prevents the entry of moisture and other foreign matter between the ends of adjacent sections 246–249 and minimizes gapping between sections 246–249 thereby adding to the aesthetic and professional appearance of door 200. Diagonal members 226, 228 231 and 232 are similarly separated or cut into a plurality of sections adjacent the interfaces between adjacent panels 211–214 thereby permitting door panels 211–214 to pivot on joints 217.

Overlay 225 is attached to the exterior surface 215 of door 200 with an adhesive material 237 which is compatible with the material of outer surface 215, the finish of outer surface 215, and with the material of overlay 225. Adhesive material 237 has a uniform application between overlay 225 and the outer surfaces 215 of panels 211–214 to bridge any gaps between overlay 225 and outer surface 215, as seen in FIG. 5. Fasteners are used to hold overlay 225 in place during the bonding process. The perimeter of overlay 225 located adjacent the outer surface 215 of door 200 is caulked or sealed with a sealant 239. As shown in FIG. 5, a bead of sealant 239 is located between the lower edges of diagonal members 226 and 228 and the outer surfaces 215 of the panels. The entry points of the fasteners into overlay 225 are similarly caulked or sealed with sealant 239.

From the foregoing detailed description of the present invention it has been shown how the objects of the invention have been obtained in preferred manners. However, modifications and equivalents of the disclosed concepts, such as those which readily occur to those skilled in the art, are intended to be included within the scope of this invention. Thus, the scope of this invention is intended to be limited only by the scope of the claims which are, or which may hereafter be, appended hereto.

What is claimed is:

1. A sectional garage door comprising a plurality of premanufactured rectangular-shaped door sections, pivoting means attached to the door sections to pivotally connect the door sections, each door section having a flush steel outer surface with an exterior coating, overlaying means secured to at least two of the door sections, the overlaying means protruding outwardly from the outer surfaces of the door sections providing the exterior of the door with a contrasting customized appearance, the overlaying means comprising a plurality of rigid structurally-strong precustomized members, at least one of the members extending between one of the door sections to an adjacent door section, the member extending between the door sections having sections with ends engaging each other when the door is in a vertically closed position, the ends separating when the door is pivoted between the open and closed positions; and adhering means and fastening means permanently securing the members to the outer surfaces of the door sections the adhering means compatible with the coating of the outer surface of the door panels and the material of the members, the adhering means comprising a relatively high-strength construction adhesive uniformly applied between the members and the outer surfaces of the door sections, and sealing means located around the perimeter of each member adjacent the outer surfaces of the door sections the adhering and sealing means preventing entry of moisture and foreign matter between the members and door sections.

2. The door of claim 1 wherein: the members are extruded polystyrene.

3. The door of claim 1 wherein the fastening means extend through the overlaying means and into the door sections to secure the overlaying means to the door sections.

4. The door of claim 1 wherein the engaging ends of the sections have co-planer engaging surfaces.

5. The door of claim 1 wherein the overlaying means comprises a plurality of linear transverse members extending across the door sections, and a pair of upright members extending from one door section to an adjacent door section, the transverse members extending between the upright members generally parallel to each other, each upright member having a central opening and end openings on each end of the member on opposite sides of the central opening.

6. The door of claim 1 wherein the overlaying means comprises a first pair of intersecting diagonal members, a second pair of intersecting diagonal members, each diagonal member extending from one door section to an adjacent door section, and an upright member extending from one door section to an adjacent door section, the upright member located between the first and second pairs of diagonal members.

7. A sectional door having an overlay comprising a plurality of pivotally connected door panels, each door panel having a generally flush steel front wall, a plurality of linear transverse members and upright members extending across the outer surface of the front walls of the door panels, each member being an elongated strip of rigid workable material, the upright members extending vertically from one door panel to an adjacent door panel, the transverse members extending between the upright members generally parallel to each other, each upright member having a central opening and end openings on each end of the upright member on opposite sides of the central opening, the upright members having a first section and a second section adjacent the first section, the first and second sections having ends engaging each in a tight fit relationship when the door is in a vertically closed position to prevent the entry of moisture and foreign matter between the ends of the first and second sections, the ends separating when the door is pivoted between the open and closed positions, adhering means compatible with the outer surfaces of the door panels and the material of the transverse members and upright members for permanently securing the members to the outer surfaces of the door panels whereby the members protrude outwardly from the outer surfaces providing the door with a contrasting appearance from the appearance of the outer surface of the door, fasteners extending through the transverse members and upright members and into the door panels to support the members on the door panels, and sealing means located around the perimeter of each member adjacent the outer surface of the door and located in the entry points of the fasteners in the door panels to prevent entry of moisture and foreign matter.

8. The door of claim 7 wherein the transverse members and upright members are extruded polystyrene.

9. The door of claim 7 wherein the engaging ends of the sections have co-planar engaging surfaces.

10. The door of claim 7 wherein the sealing means is a bead of polyurethane sealant located around the perimeter of the members adjacent the outer surface.

11. A premanufactured sectional flush steel garage door comprising: a first door panel and a second door panel pivotally connected to the first door panel, an overlay having a plurality of precustomized members of rigid workable material secured to the door panels and protruding outwardly from the outer surfaces of the door panels to customize the external appearance of the door, adhering means permanently attaching the members to the door panels, and sealing means located around the perimeter of the members adjacent the outer surfaces of the door panels, at least one of the members extended from the first door panel to the second door panel and having a first section and second section adjacent the first section, the first and second sections having ends with co-planar and abutting surfaces when the door is in a vertically closed position, the ends being in alignment with the interfaces between the first and second door panels to eliminate gapping between the first and second sections when the door is in the closed position.

12. The door of claim 11 wherein the adhering means comprises a construction adhesive uniformly applied between the members and the outer surfaces of the door panels, and fasteners securing the members to the door panels.

13. The door of claim 12 wherein the sealing means comprises a bead of polyurethane sealant.

* * * * *